US005578903A

United States Patent [19]

Pepi

[11] Patent Number: 5,578,903

[45] Date of Patent: Nov. 26, 1996

[54] EXTERNAL ELECTRIC CONNECTIONS FOR FLAT DISPLAY SCREENS

[75] Inventor: Richard Pepi, Pourrieres, France

[73] Assignee: Pixtel International, Rousset, France

[21] Appl. No.: 371,103

[22] Filed: Jan. 11, 1995

[51] Int. Cl.[6] ..... H01J 5/48

[52] U.S. Cl. ..... 313/583; 313/584; 313/495; 313/51

[58] Field of Search ..... 313/51, 573, 574, 313/583, 584, 585, 495

[56] References Cited

U.S. PATENT DOCUMENTS

| | | | |
|---|---|---|---|
| 4,039,882 | 8/1977 | Kupsky et al. | 313/583 |
| 4,100,456 | 7/1978 | Kobayakawa et al. | 313/583 |
| 4,113,896 | 9/1978 | Keiner et al. | 313/583 |
| 5,107,176 | 4/1992 | Endo et al. | 313/583 |

*Primary Examiner*—Sandra L. O'Shea
*Assistant Examiner*—Vip Patel
*Attorney, Agent, or Firm*—Plevy & Associates

[57] ABSTRACT

A flat display device includes two parallel plates each being provided, on its inner surface, with internal conductors extending outside a vacuum chamber provided between the two plates. A first plate has at least one lateral portion protruding with respect to the second plate. The screen further includes at least one insulating bar fastened onto the inner surface of the protrusion and is provided, on its surface facing the edge of the second plate and vertically with respect to the extensions of the inner conductors of the first plate, with grooves defining conductive transverse passageways.

12 Claims, 4 Drawing Sheets

EXTERNAL ELECTRIC CONNECTIONS FOR FLAT DISPLAY SCREENS

BACKGROUND OF THE INVENTION

Field of the Invention

The present invention relates to flat display screens. It more particularly applies to electric connections to a vacuum airtight chamber of a flat display screen on device limited by two plates constituting the bottom and the viewing surface of the screen, respectively.

Conventionally, a flat display device is constituted by two external rectangular plates, for example made of glass. These two plates are assembled with a sealing joint and are spaced one from the other. For a Field Effect Display (FED), a microtip display, or a Vacuum Fluorescent Display (VFD), the space between the two glass plates is evacuated, whereas for a plasma display, this space is filled with a low pressure gas.

FIGS. 1A and 1B schematically represent a microtip flat display device which constitutes an exemplary device to which the present invention can apply. FIG. 1B is a cross-sectional view along line B—B' of the rod view represented in FIG. 1A.

Such a microtip display basically comprises a microtip cathode and a grid provided with holes facing the microtips. The cathode faces a cathodoluminescent anode having a glass substrate 1 that constitutes the display surface. For the sake of simplification, details of the cathode, grid and anode in the useful surface of the display, are not represented in FIGS. 1A and 1B.

An example of the operation mode and the detailed structure of such a microtip display is disclosed in U.S. No. Pat. 4,940,916 assigned to Commissariat à l'Energie Atomique.

The cathode is divided into columns and is constituted, on a glass substrate 2, by cathode conductors made of a conductive layer arranged according to lattices. The microtips are formed on a resistive layer deposited over the cathode conductors and are disposed inside the lattices defined by the cathode conductors. The cathode is associated with the grid that is divided into rows. The intersection of a grid row and a cathode column defines a pixel.

This device uses the electric field generated between the cathode and the grid so that electrons are extracted from the microtips toward the phosphor elements of the anode. In a color display, the anode is provided with alternate strips of phosphor elements, each corresponding to a color (blue, red, green). The strips are mutually separated by an insulator. The phosphor elements are deposited over electrodes, constituted by corresponding strips of a transparent conductive layer such as indiumtin oxide (ITO). The groups of blue, red, and green strips are alternatively polarized with respect to the cathode, so that the electrons extracted from the microtips of a pixel of the grid/cathode are selectively directed toward the opposed phosphor elements of each color.

The cathode/grid and the anode are fabricated separately on the two substrates, or plates, 2 and 1. Then, they are assembled with a peripheral sealing joint 3. A vacuum chamber 4 is provided between the two plates to allow the electrons issued from the cathode to flow toward the anode.

The operation of such a display requires the provision, outside chamber 4, of electric connections from the display to an electronic control system to allow the adequate polarization of the cathode columns, grid rows and anode strips. In the case of a display with a switched anode and with a matrix addressing of the cathode/grid, the number of connections corresponds to the sum of the number of columns of the cathode conductors, of the number of grid rows and of the number of groups of phosphor element strips. For a monochrome display a single anode connection is required To achieve these connections outside chamber 4, the columns of cathode conductors 5 and the grid rows 6 are conventionally extended outside the useful surface of the display on the inner surface of plate 2. Similarly, electric interconnection paths (not shown) of the groups of phosphor element strips are extended on the inner surface of plate 1 outside its useful surface. The useful surface of the display is represented in FIG. 1A in dotted lines 7.

The two plates 1 and 2 are assembled together and are shifted so that the ends of conductors 5 and 6 and the interconnection paths of the phosphor elements are accessible from outside. In other words and as illustrated in FIG. 1A, the plate 2 is larger than plate 1 and the plates are assembled, one of the edges only being aligned.

A drawback of conventional displays is that the protrusions 8 and 9 on plate 2 on two sides of the display for the cathode and grid connections, and on plate 1 on one side of the display for the anode connections constitute weak areas once the display is fabricated.

It has been devised to achieve, in the useful surface of the cathode/grid plate, crossing conductive areas to transfer on the outer surface of this plate row and column contacting points, thereby suppressing the plate protrusions. The implementation of such a method requires the use of complex tools to pierce numerous holes in the cathode/grid plate. In addition, the defective filling of these holes can cause failure of the tightness of the inner chamber 4, thus polluting the inner vacuum, which is detrimental for the lifetime of the display.

Another drawback of conventional displays lies in that the electric connections cannot be grouped on the same surface of the display, which complicates the subsequent coupling of these connections with an electronic control system.

SUMMARY OF THE INVENTION

An object of the present invention is to avoid these drawbacks and to provide a flat display screen or device in which the coupling of the external electric connections eliminates the outer protrusion of one plate with respect to the other, while preventing the inner chamber from being polluted.

Another object of the present invention is to provide a flat display device in which all the external electric connections are grouped on the same surface of the screen.

Another object of the invention is to provide such a screen manufacturable without modifying the conventional manufacturing of the plates constituting the screen.

To achieve these objects, the present invention provides a flat display screen including two parallel plates, each plate being provided, on its inner surface, with internal conductors extending outside the vacuum chamber which is provided between the two plates, one side at least of a first plate protruding with respect to the second plate. At least one insulating bar, fastened onto the inner surface of the protrusion, is provided, on its surface facing the edge of the second plate and vertically with respect to the extension of the internal conductors of the first plate, with grooves defining conductive transverse passageways ending flush with the outer surface of the second plate.

According to an embodiment of the invention, each bar also includes grooves defining conductive passageways on its surface opposite to the surface including the above-mentioned grooves.

The present invention also provides a manufacturing method for providing external electric connections of a flat display screen which is limited by two parallel plates, each being provided, on its inner surface, with conductors extending outside the vacuum chamber provided between the two plates. The method includes the steps of depositing, on at least one lateral protrusion of the first plate, paths connecting the conductors of a second plate; providing conductive spacers between each connection path and a conductor vertically with respect to the place where the path was formed; fastening on the inner surface of the protrusion an insulating bar provided with grooves on its surface facing the edge of the second plate and defining with the latter wells vertically disposed with respect to each conductor of the first plate and to each path connecting the conductors of the second plate; and filling the wells with a conductive material so as to obtain contacting points on the outer surface of the second plate.

The foregoing and other objects, features, aspects and advantages of the invention will become apparent from the following detailed description of the present invention when taken in conjunction with the accompanying drawings.

BREIF DESCRITPION OF DRAWINGS

FIGS. 1A and lB, above described, are designed to disclose the state of the art and the problem encountered;

Figure 4:
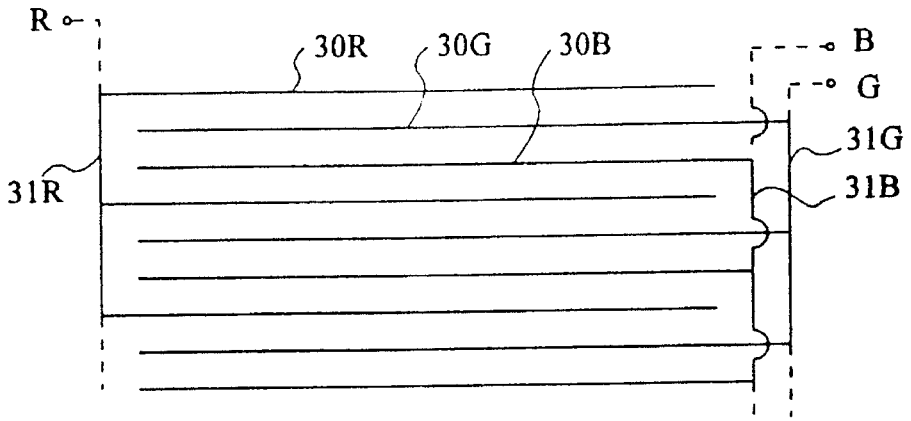
Figure 5A:
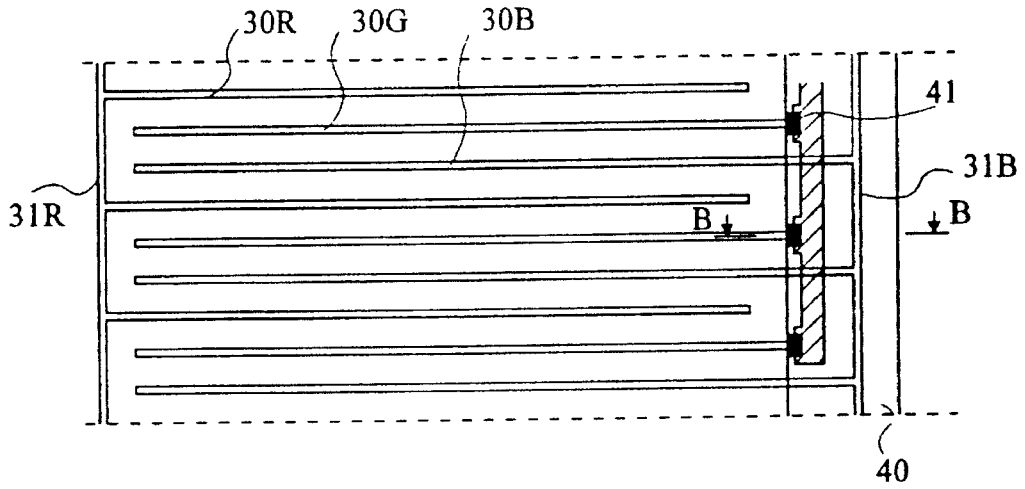
Figure 5B:
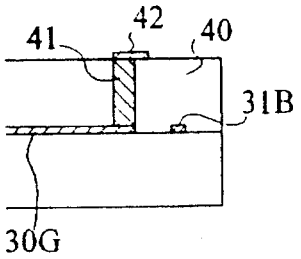
Figure 6:
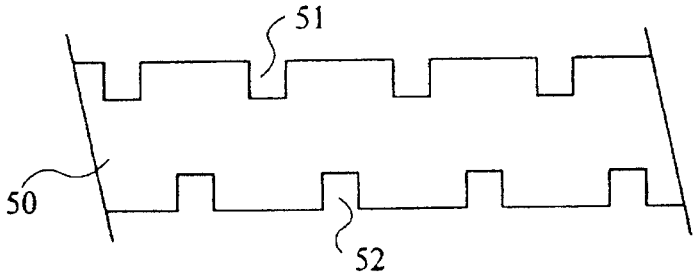

FIG. 4 schematically represents the anode connections in a conventional color screen;

FIGS. 5A and 5B are a top view and a cross-sectional view, respectively, of the anode connections of a flat display screen according to the invention; and FIG. 6 illustrates an alternative embodiment of a bar according to the invention.

DETAILED DESCRIPTION

For the sake of simplification, the figures are not drawn to scale and the same elements are labelled in the different figures with the same references. Also, the details constituting the layers in the useful surface of the device are not represented.

Figure 2A:
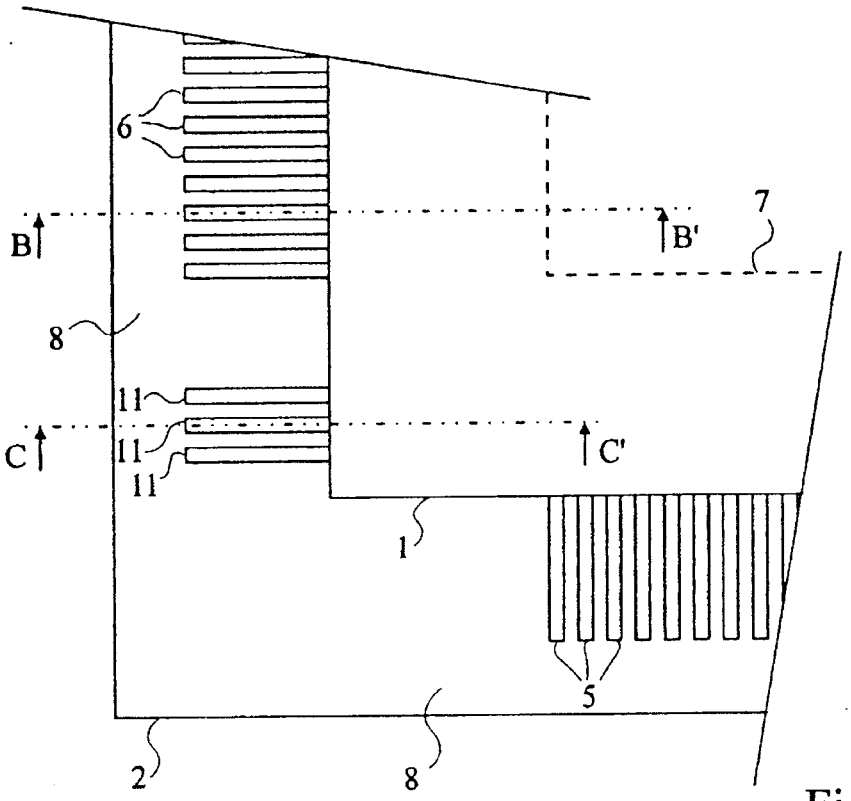
FIG. 2A is a partial top view and FIGS. 2B and 2C are partial cross-sectional views of an embodiment of a flat display screen or device according to the invention, before the electric connections are transferred on one of its outer surfaces.
Figure 2B:
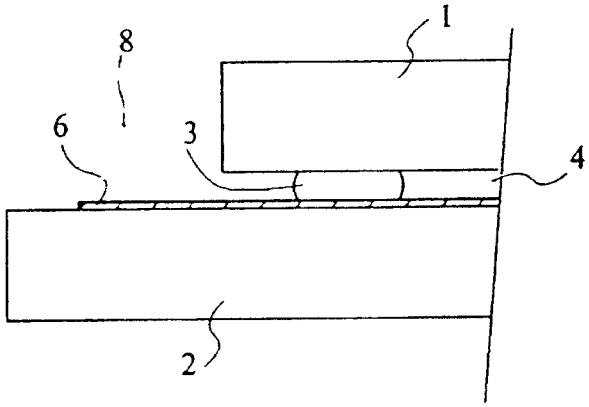
Figure 2C:
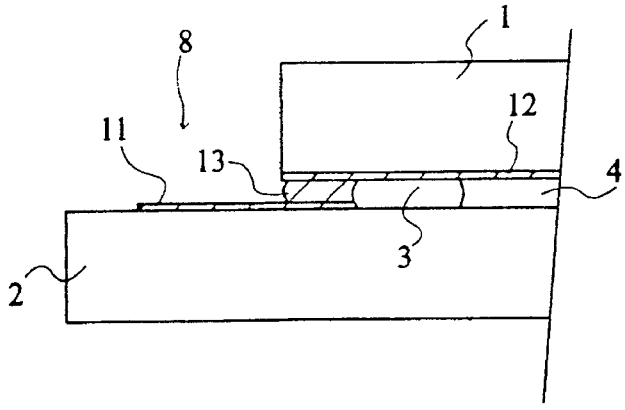

FIGS. 2A–2C represent a corner of a microtip flat display screen or device according to an embodiment of the invention, before the electric connections are transferred on one of the outer surfaces of the screen. FIG. 2B is a cross-sectional view along line B—B' of the top view of FIG. 2A. FIG. 2C is a cross-sectional view along line C–C' of FIG. 2A.

Figure 1A:
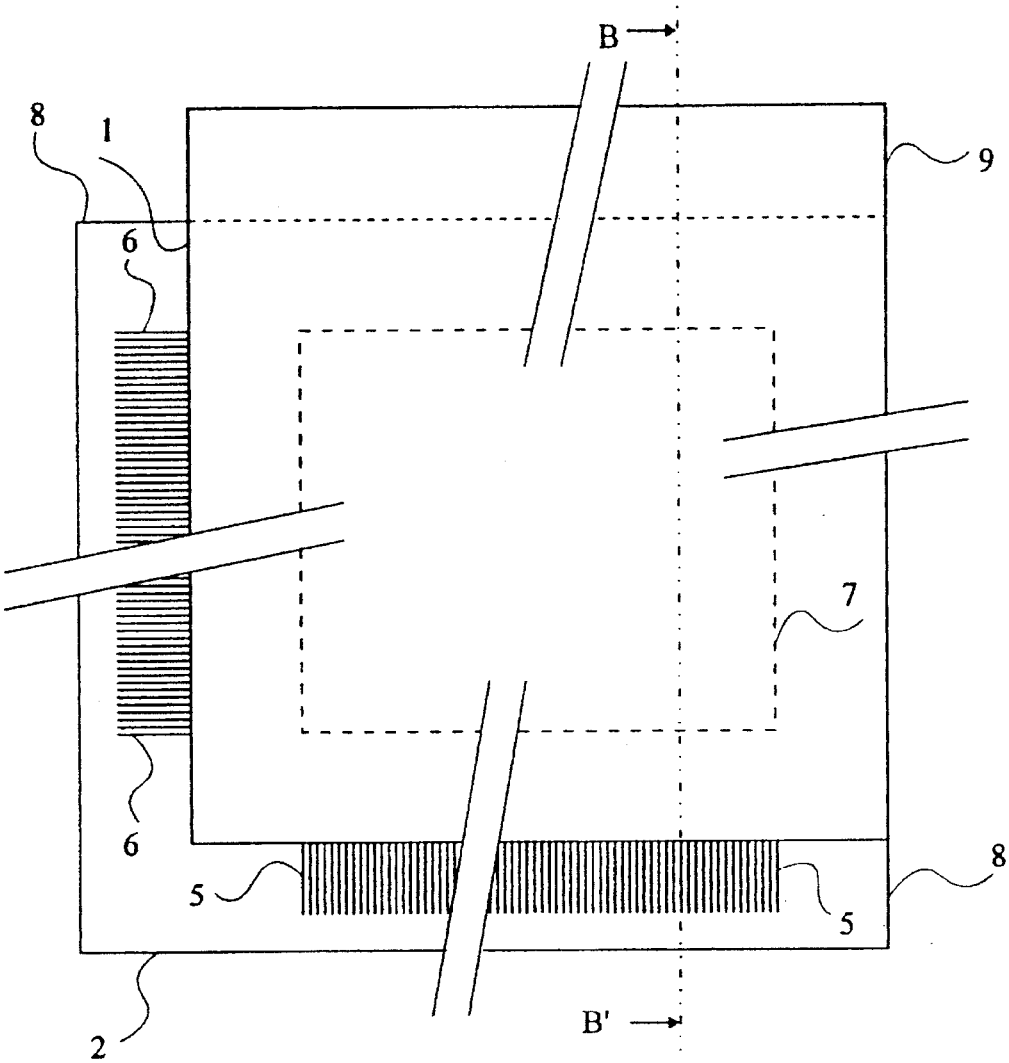
Figure 1B:
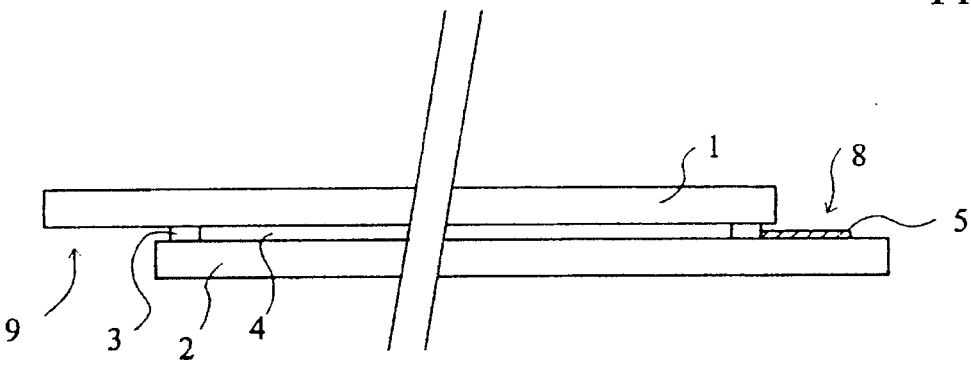

These figures correspond to an enlarged view of the lower left-hand corner of the drawing in FIG. 1A.

The microtip device is as previously constituted by two parallel plates 1 and 2 assembled by a peripheral sealing joint 3 and constituting an inter-electrode chamber 4.

A first plate 2 provided with the cathode and the grid of the microtip screen includes, as previously, conductive paths 5 and 6 extending cathode columns and grid rows, respectively, outside the inter-electrode chamber 4.

In a color device such as represented, three conductive paths 11 are added on the inner surface of plate 2. These paths 11 are designed to connect on the internal surface of plate 2 three interconnection paths 12 (FIG. 2C) of the anode phosphor strips formed on plate 1.

Plate 2, as in the case of FIGS. 1A and lB, has lateral protrusions 8 with respect to the outline of plate 1. These protrusions 8 are provided on two sides of plate 2 which are perpendicular one with respect to another.

The conductors 5, 6, and 12 are thus extended beneath the sealing joint 3 and over the internal surface of their respective plate to allow the coupling of the cathode columns, grid rows and anode strips outside the inter-electrode chamber 4 (FIGS. 2B and 2C). In contrast, the connection paths 11 are provided on plate 2 only outside the inter-electrode chamber 4. Paths 11 are deposited on plate 2 so that their ends, on the useful surface side, face the end of an interconnection path 12 positioned in the corner of plate 1.

To achieve electric connection between each connection path 11 and the inter-connection path 12 with which the path 11 must be associated, a weld spot 13 is deposited between each path 11 and the path 12 which faces it.

The provision of the protrusion 8 of plate 2 is used to transfer on the inner surface of one plate all the polarization conductors. This is possible because the useful surface 7 of the screen is distant from the edges of plate 1 which has no protrusion. This distance is much greater than the distance needed to form a few conductive connection paths, and is especially the result of the presence of the peripheral sealing joint 3 and the required clearance so that there is no possibility, during the fusion of the glass constituting this joint, for the joint 3 to overlap the useful surface of the screen. Conventionally, a distance ranging from 3 to 10 mm is provided between the useful surface 7 and the edges of the plate, which is quite sufficient for depositing three conductive paths.

In addition, although all the connection paths 11 are represented in the same corner of the screen, the two free ends of protrusions 8 could be used, thus allowing to use three corners of the screen to connect each time one of the three inter-connection paths 12.

It should be noted that, up to this step, the invention does not need specific tools with respect to the usual tools used to achieve the conductors of the different elements of the screen. However, the protrusion 9 (FIGS. 1A and lB) which is provided in the conventional screens to electrically connect inter-connection paths of phosphor strips of the anode is no longer needed. According to the invention, only one of the two plates has, on two sides, extensions 8 protruding with respect to the outline of the other plate. The achievement of the connection paths 11 can, if required, be achieved after the assembly of plates 1 and 2, i.e, on a conventional structure. In this case, inter-connection paths of the phosphor element strips of plate 1 should be grouped in one or more corners of plate 1.

Although the above description of FIGS. 2A–2C relates to the connection of all the conductors on the inner surface of the cathode plate 2, the inner surface of the anode plate 1 can also be used to group all the conductors. In this case, plate 1 extends, on two perpendicular sides, with respect to the outline of plate 2. The inter-connection paths 12 of phosphor element strips are grouped in one or more corners of the screen to leave the portion of the protrusions located in the extension of the useful surface 7 free for the provision of connection paths 11. Here, these connection paths are much more numerous because they must correspond to the cathode columns and to the grid rows. The spot welding of the electric connections of the connection paths with the cathode and grid conductors requires, in this case, a higher accuracy than in the case of the connection paths of the anode conductors. Indeed, the pitch of the cathode columns and of the anode lines is conventionally approximately 0.3 mm in order to correspond to the size of a screen pixel.

After completion of the structure of FIGS. 2A–2C, in which all the conductors are grouped on the inner surface of the same screen plate, the invention provides for the transfer of the electric connections of these conductors on the outer surface of the opposite plate.

Figure 3A:
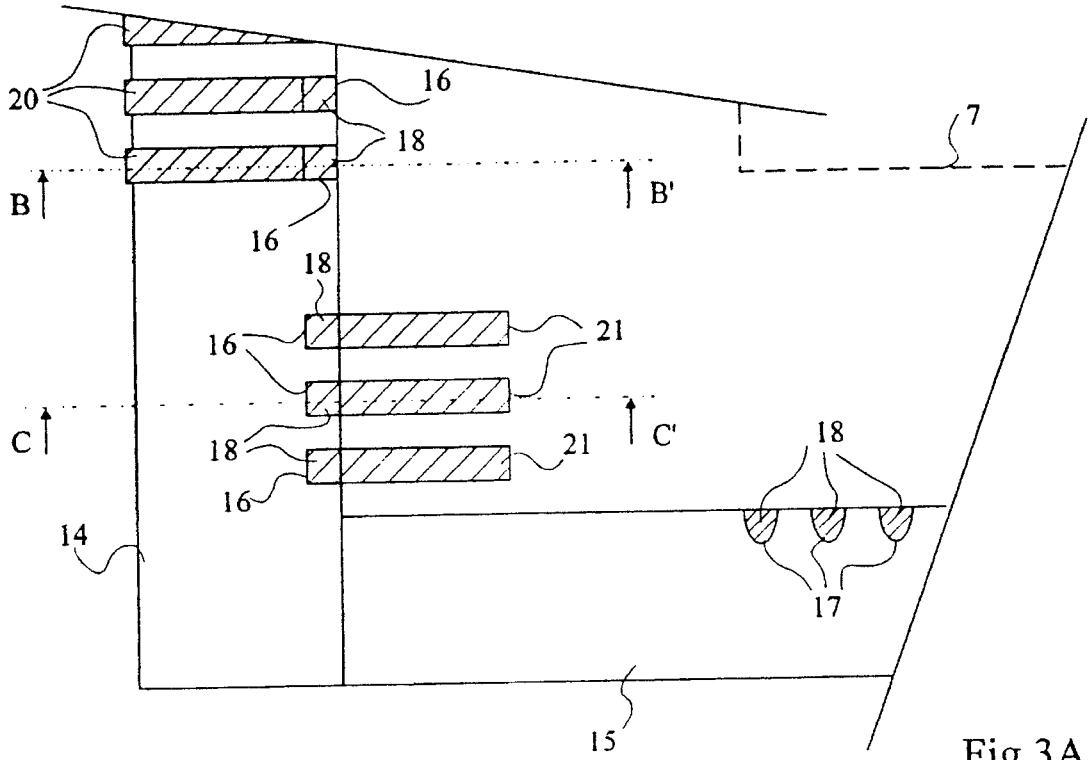
FIG. 3A is a partial top view and FIGS. 3B and 3C are partial cross-sectional views of an embodiment of a flat display screen according to the invention after fabrication.
Figure 3B:
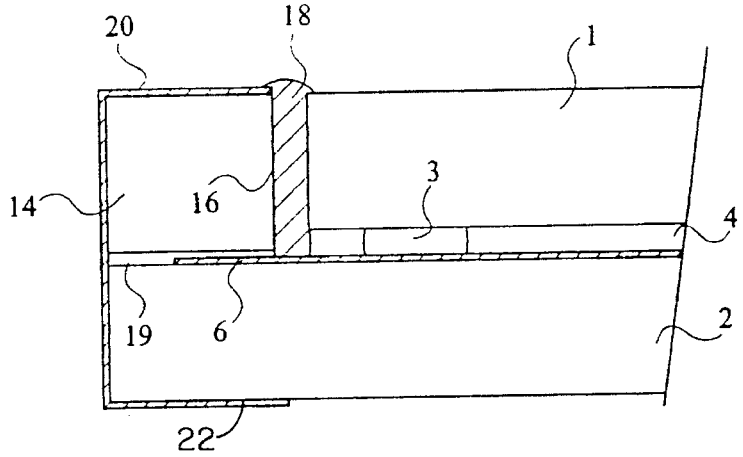
Figure 3C:
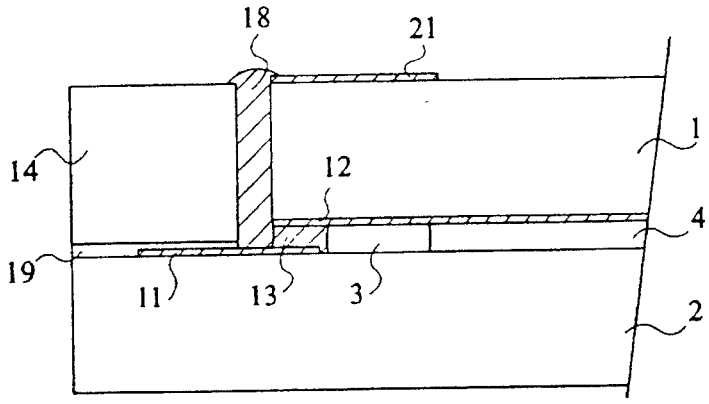

FIGS. 3A–3C represent the corner of the screen as represented in FIGS. 2A–2C once the screen is fabricated. FIG. 3B is a cross-sectional view along line B—B' of the top view of FIG. 3A. FIG. 3C is a cross-sectional view along line C–C' of FIG. 3A.

For the sake of simplification, FIGS. 3A–3C are further enlarged as compared to FIGS. 2A–2C.

Notched insulating bars 14 and 15 are fastened onto the protrusions 8 of plate 2. These bars comprise, on their surface facing a side of plate 1, grooves 16 and 17 which are vertical with respect to each path 5, 6 and 7. These grooves define transverse conductive passageways to render all the conductive paths present on the inner surface of protrusions 8 of plate 2 electrically accessible from the outer surface of plate 1.

The length and width of bars 14 and 15 correspond the length and width of protrusions 8, respectively. The height of the bars coincide to the thickness of the plate 1 added to the thickness of the inter-electrode chamber 4, so that, once the bars are fastened, the screen has a regular rectangular parallelepiped shape. The insulating bars 14 and 15 are, for example, made of glass and are fastened to the protrusions 8 by a sealing joint 19, for example made of fusible glass.

The pitch and the position of the grooves 16 and 17 correspond to the pitch and the position of the conductive paths 5, 6 and 11. The section of these grooves can be a square 16, as represented on bar 14, or can be a half-circular portion 17 as represented on bar 15 as an alternative, or may have any other suitable shape. Such grooves can be achieved in glass bars which are, for example, sawn off, ground, moulded or obtained by any other suitable method.

Grooves 16 and 17 are filled with a conductive material, for example a solder material, to achieve transverse passageways 18. The grooves can be filled prior to positioning bars 14 and 15, and then be fused once the bars are positioned. The grooves can also be filled by pouring fused solder into the wells defined by the grooves and the opposed edge of plate 2, once the bars 14 and 15 are positioned. Grooves 16 and 17 are then preferably pre-metallized to provide proper diffusion of the solder.

The weld spots 13 previously achieved at the conductive paths 11 prepare the electric connection between the paths 12 and 11, and thus optimize the electric connection between the transverse passageways 18 and paths 12. Indeed, the small thickness of the inter-electrode chamber 4 (approximately 0.2 mm) could prevent the solder of the transverse passageways from flowing without formation of air bubbles, which would impair the electric conduction. Anyway, it is preferred to form connection paths 11 to provide a pre-metallization which improves the diffusion of the solder in a direction perpendicular to the filling.

Thus, the invention suppresses the protrusion of one of the plates with respect to the other in the fabricated screen and thereby suppresses the weak areas constituted by these protrusions. In addition, the invention takes advantage of the suppression of the protrusions to transfer all the polarization conductors of the screen elements on the outer surface of one of the plates. Thus, the invention achieves this transfer outside the useful surface of the screen without any risk of pollution of the chamber.

In addition, the width of the protrusions 8 to which bars 14 and 15 are fastened can be reduced since these protrusions no longer serve to connect a lateral connector of the comb-type, but are only used for the transverse transfer of conductors which is achieved over a narrow width of the bars.

Rendering the polarization conductors accessible from the outer surface of one of the plates significantly simplifies the connections with a control electronic system. Conductive paths 20 can be provided on the free surfaces of the bars, as represented in FIG. 3A for bar 14. Conductive paths 21, lined up with the bar grooves, can also be disposed on the outer surface of plate 1. Paths 20 or 21 can be connected externally, on the outer surface of plate 2, thus allowing the implantation of the control electronic system 22 directly on the outer surface of the cathode plate. Since the transverse passageways 18 end on the outer surface of the anode plate 1 which usually constitutes the screen surface, care should be taken so that, if paths 21 are deposited on the outer surface of plate 1, they remain outside the useful surface 7 of the screen.

However, it is preferred to transfer directly all the conductors on the outer surface of the cathode plate 2 by having the transverse passageways 18 to arrive flush with the outer surface of this plate, which thus avoids the use of conductive paths deposited on the outer edges of the screen.

For this purpose, as disclosed with relation to FIGS. 2A–2C, in a manner not represented, all the conductors must merely be grouped on the internal surface of the anode plate 1 prior to positioning the bars. Thus, the bars are placed on the protrusions of the anode plate and the transverse conductive passageways directly end at the rear surface of the screen.

Such an embodiment allows the transfer of all the polarization conductors on the rear surface of the screen. So, the surface unused for display purposes is reduced and several screens can be arranged side by side.

FIG. 4 schematically represents the shape of the anode conductors in a conventional flat color display screen. Conductive strips 30R, 30G and 30B are mutually parallel. These strips are transparent and are coated with luminescent red, green and blue material, respectively. Strips 30R are interconnected through a conductor 31R. Strips 30G are interconnected through a conductor 31G. Strips 30B are interconnected through a conductor 31B. Conductors 31R, 31G and 31B correspond to the inter-connection paths 12 of FIGS. 2C and 3C. This structure requires that insulated crossings be achieved between one group of conductive strips (30G) and a conductor (31B). Such crossings complicate the fabrication of the anode.

As represented in FIGS. 5A and 5B, the use of a third bar according to the invention solves the above problem. A bar is disposed along a third side of the structure. The grooves 41 of the bar contact each conductor 30G. A conductive path 42 connects the upper surfaces of each metallization provided in grooves 41 and corresponds to conductor 31G. Conductor 31B is formed beneath the bar 40. Of course, the various alternatives described above apply to this structure.

FIG. 6 illustrates an alternative embodiment of a bar usable according to the invention. Bar 50 has grooves on two opposite surfaces. The grooves 51 on a first surface correspond to the above-described grooves. Then, the grooves 52 on the opposite surface are disposed outside the structure. This alternative allows to achieve grooves having a pitch higher than the pitch of the paths to be connected.

As is apparent to those skilled in the art, various modifications can be made to the above described specific embodiment. In particular, each described component can be replaced with one or more elements having the same function. For example, the two linear bars could be formed by a single corner-shaped part.

Although the above disclosure describes the transfer of all the electric connections on the same outer surface of the screen, in some applications, it is possible to transfer only the electric connections of one of the plates on the outer surface of the other plate and thus not use the connection paths.

In addition, although the invention has been described in connection with microtip devices, it also applies to any flat display device.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended to be limiting. The invention is limited only as defined in the following claims and the equivalents thereto.

I claim:

1. A flat display device including a planar first plate (2) and a planar second plate (1) parallel one with respect to the other and each being provided, on its inner surface, with internal conductors (5, 6, 12) extending outside a vacuum chamber (4) provided between the two plates, the first plate (2) having at least one lateral protruding portion (8) protruding with respect to the second plate (1), wherein at least one insulating bar (14, 15) is fastened onto the inner surface of said protruding portion (8) and is provided, on its surface facing the edge of said second plate (1) and in register with extensions of said inner conductors (5, 6) of the first plate (2), with grooves (16, 17) defining conductive transverse passageways (18), said at least one insulating bar having an upper surface that is substantially coplanar with an upper surface of said second plate.

2. The flat display device of claim 1, wherein said at least one lateral protruding portion (8) further includes on its inner surface connection paths (11) contacting said extensions of the inner conductors (12) of the second plate (1).

3. The flat display device of claim 2, wherein said connection paths (11) are individually connected to said extensions of the internal conductors (12) of the second plate (1) through conductive spacers (13) disposed outside the vacuum chamber (4).

4. The flat display device of claim 1, wherein said second plate (1) carries connection tracks (21) for connecting said transverse passageways (18) to a control electronic system implanted on its outer surface.

5. The flat display device of claim 1, wherein said grooves (16, 17) are filled with a conductive material once said bar (14, 15) is fastened to said protrusion (8).

6. The flat display device of claim 1, wherein said flat display device is a flat microtip display device and said second plate (1) bears the cathode and the grid of said flat microtip display device, electronically bombarding a cathodoluminescent anode supported by said first plate (2).

7. The flat display device of claim 6, including, on the inner surface of a first lateral protrusion of the anode plate, connection paths of cathode conductors and, on the inner surface of a second lateral protrusion of the anode plate, connection paths of grid conductors, anode conductors extending form the useful surface of the anode plate near a corner defined by the intersection of said protrusions which are mutually perpendicular.

8. The flat display device of claim 1, wherein said first plate (2) supports the cathode and the grid of a microtip flat display screen electronically bombarding a cathodoluminescent anode supported by said second plate (1).

9. The flat display device of claim 8, including near a corner defined by the intersection of two protrusions (8) which are mutually perpendicular and supported by the cathode plate (2) paths (11) for connecting the anode conductors (12).

10. The flat display device of claim 6, wherein the anode conductors include three sets of parallel paths, the conductors of at least two sets extending beneath an isolating bar, each conductor of at least one of said two sets being individually connected to a conducting passageway.

11. The flat display device of claim 1, wherein each bar includes a second set of grooves defining conductive passageways on its surface opposite to the surface including the first grooves.

12. A method for providing external electric connections of a flat display device which is limited by planar first and second plates (2, 1) parallel one with respect to the other and each being provided, on its inner surface, with conductors (5, 6, 12) extending outside the vacuum chamber (4) defined by the two plates, the method comprising the steps of:

providing, on at least one lateral protrusion (8) of the first plate (2), paths (11) connecting the conductors (12) of the second plate (1);

depositing conductive spacers (13) between each connection path (11) and a facing conductor (12);

fastening on the inner surface of said protrusion (8) an insulating bar (14, 15) such that an upper surface of said insulating bar is substantially coplanar with an upper surface of said second plate, said insulating bar being provided with grooves (16, 17) on its surface facing an edge of said second plate (1) and defining with the latter wells vertically disposed with respect to each conductor (6, 7) of the first plate (2) and to each path (11) connecting the conductors (12) of the second plate (1); and filling said wells with a conductive material (18) so as to obtain contacting points on the outer surface of said second plate (1).

* * * * *